US009694224B1

(12) United States Patent
Ho et al.

(10) Patent No.: US 9,694,224 B1
(45) Date of Patent: Jul. 4, 2017

(54) INTEGRATED STEP AND JUMP EXERCISE DEVICE

(71) Applicants: Wei-Teh Ho, Taipei (TW); Willy Wei Yu Ho, Taipei (TW)

(72) Inventors: Wei-Teh Ho, Taipei (TW); Willy Wei Yu Ho, Taipei (TW)

( * ) Notice: Subject to any disclaimer, the term of this patent is extended or adjusted under 35 U.S.C. 154(b) by 0 days.

(21) Appl. No.: 14/982,654

(22) Filed: Dec. 29, 2015

(51) Int. Cl.

| | |
|---|---|
| ***A63B 21/00*** | (2006.01) |
| ***A63B 5/11*** | (2006.01) |
| ***A63B 23/04*** | (2006.01) |
| ***A63B 23/12*** | (2006.01) |

(52) U.S. Cl.
CPC ..... *A63B 5/11* (2013.01); *A63B 21/00047* (2013.01); *A63B 23/0482* (2013.01); *A63B 23/0494* (2013.01); *A63B 23/1236* (2013.01)

(58) Field of Classification Search
CPC ..... A63B 21/02
USPC ..... 482/27, 28, 77
See application file for complete search history.

(56) References Cited

U.S. PATENT DOCUMENTS

2014/0336005 A1* 11/2014 Miller ..... A63B 5/11 482/27
2015/0045188 A1* 2/2015 Allen ..... A63B 71/0054 482/27

* cited by examiner

*Primary Examiner* — Jerome W Donnelly
(74) *Attorney, Agent, or Firm* — Blakely, Sokoloff, Taylor & Zafman LLP

(57) ABSTRACT

An exercise device includes a first tubular frame having a flexible fabric attached thereon, a second tubular frame having a rigid board mounted thereon, and at least three elongate support members disposed between and separate the first tubular frame and the second tubular frame. Each of the elongate members includes a first end fixedly mounted on the first tubular frame and a second end fixedly mounted on the second tubular frame, such that a first cross plane of the first tubular frame is substantially parallel to a second cross plane of the second tubular frame. When the second tubular frame is placed on a substantially flat surface, the exercise device can be used as a jumping exercise device. When the first tubular frame is placed on the substantially flat surface, the exercise device can be used as a stepping exercise device.

18 Claims, 12 Drawing Sheets

INTEGRATED STEP AND JUMP EXERCISE DEVICE

FIELD OF THE INVENTION

Embodiments of the present invention relate generally to physical training machines, and in particular, to exercise machines commonly referred to a step and jump exercise device.

BACKGROUND

Whereas people today are more conscious of fitness thanks to the ever-improved living standard, fitness equipment has become very popular. However, some of the fitness equipment emphasizing sit up in bear hands may get too rough and violent resulting in stretch in larger angles that causes injuries to the user having overweighed problem or in middle ages or elder. Furthermore, the sit up may become so monotonous and the user may be disinterested very quickly. Besides, fitness equipment generally available in the market either consumes too much space at home or is very expensive, plus other factors, such as the users in a family whose age, physical strength vary, the confined space available at home, the limit to only one function, and nature and length of training session.

A jump exercise device such as a trampoline is commonly used to exercise one body part of a human body, while a step exercise device is used to exercise another body part of a human body. In order to exercise these two different body parts, a user has to possess two different exercise devices, which sometimes are more expensive and take more storage space.

BRIEF DESCRIPTION OF THE DRAWINGS

Embodiments of the invention are illustrated by way of example and not limitation in the figures of the accompanying drawings in which like references indicate similar elements.

DETAILED DESCRIPTION

Various embodiments and aspects of the inventions will be described with reference to details discussed below, and the accompanying drawings will illustrate the various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present inventions.

Reference in the specification to "one embodiment" or "an embodiment" means that a particular feature, structure, or characteristic described in conjunction with the embodiment can be included in at least one embodiment of the invention. The appearances of the phrase "in one embodiment" in various places in the specification do not necessarily all refer to the same embodiment.

According to some embodiments, a combo exercise device can be used either as a jumping device or a stepping device. An exercise device includes a first tubular frame having a flexible fabric attached thereon, a second tubular frame having a rigid board mounted thereon, and at least three elongate support members disposed between and separate the first tubular frame and the second tubular frame. Each of the elongate members includes a first end fixedly mounted on the first tubular frame and a second end fixedly mounted on the second tubular frame, such that a first cross plane of the first tubular frame is substantially parallel to a second cross plane of the second tubular frame. When the second tubular frame is placed on a substantially flat surface, the exercise device can be used as a jumping exercise device and the flexible fabric mounted on the first tubular frame can be used as a jumping mat. When the first tubular frame is placed on the substantially flat surface, the exercise device can be used as a stepping exercise device and the rigid board mounted on the second tubular frame can be used as a stepping board. In one embodiment, each of the first tubular frame and the second tubular frame includes a circular steel frame and the fabric and the rigid board are in a circular shape fitting within a circular area within the circular steel frame.

Figure 1:
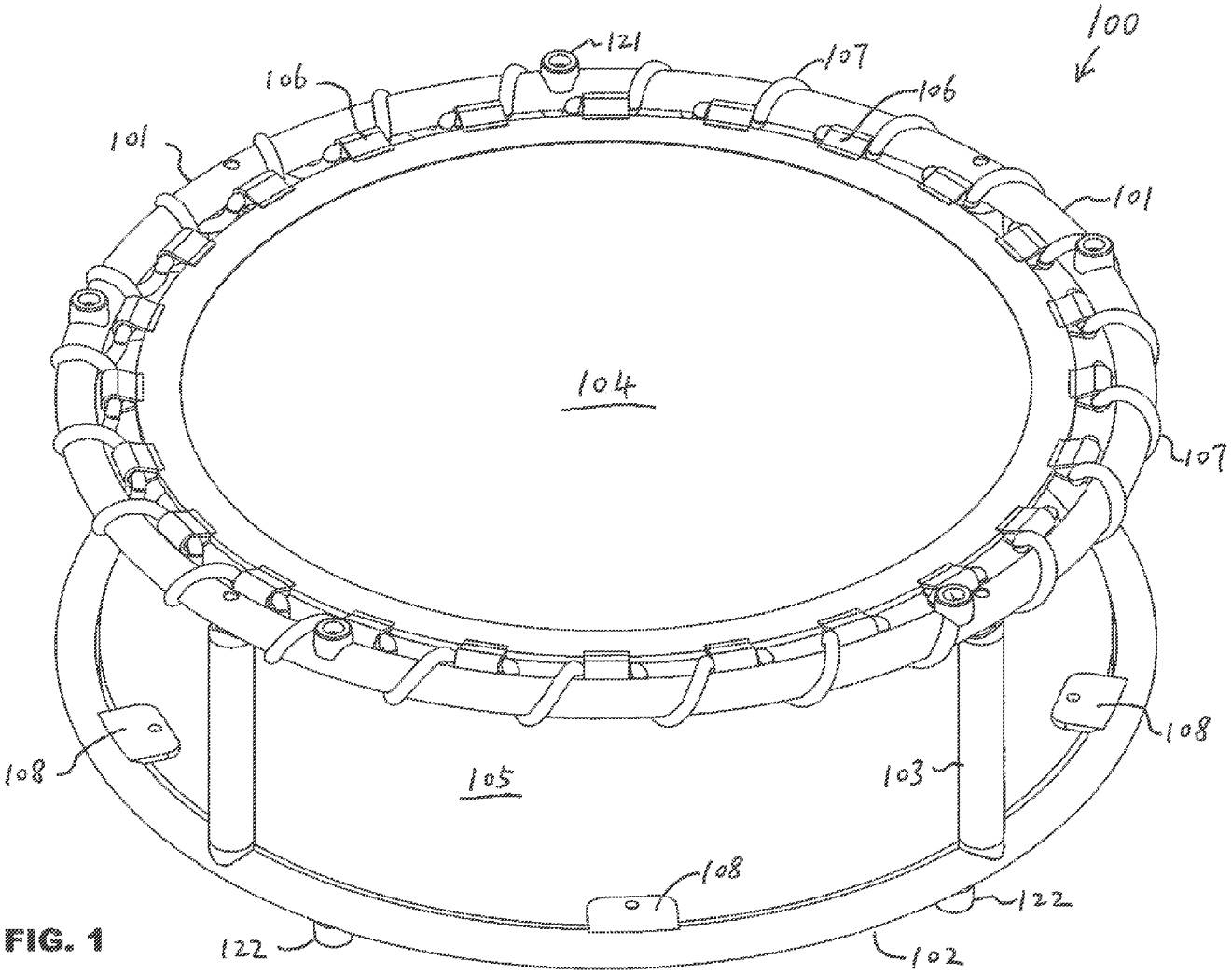
FIGS. 1-2 show a perspective view of an exercise device according to certain embodiments of the invention.

FIG. 1 shows a perspective view of an exercise device according to one embodiment of the invention. Referring to FIG. 1, exercise device 100 includes first tubular frame 101 and second tubular frame 102. In this embodiment, first tubular frame 101 and second tubular frame 102 are formed in a circular ring. In one embodiment, each of first tubular frame 101 and second tubular frame 102 may be formed using a steel rod or steel tube (or any other strong enough material, such as aluminum alloy, fiber glass, etc.) molded or bent into a circular ring. Note that in this embodiment, first tubular frame 101 and second tubular frame 102 are shown and described in a circular shape. However, other shapes, such as rectangular, square, or oval shapes, may also be utilized.

In one embodiment, exercise device 100 further includes a strong fabric or cloth 104 (e.g., canvas) stretched and tied to the first tubular frame 101 to form a bouncing mat or bouncing bed. Exercise device 100 further includes a hard or rigid board 105 mounted onto second tubular frame 102. Rigid board 105 may be made of wooden material. The shapes of fabric 104 and rigid board conform to the shapes of first tubular frame 101 and second tubular frame 102, respectively. In this embodiment, both fabric 104 and board 105 are in a circular shape with a diameter slightly less than the diameters of first tubular frame 101 and second tubular frame 102, such that they can fit within interior edges of first tubular frame 101 and second tubular frame 102 without being stretched over or covering tubular frames 101-102.

In addition, exercise device 100 further includes a set of support members or legs 103 distributed substantially evenly along a perimeter of the first tubular frame 101 and second tubular frame 102 to connect and provide support to first tubular frame 101 and second tubular frame 102. In one embodiment, each of support members 103 is fixedly mounted on first tubular frame 101 and second tubular frame 102 substantially perpendicular to a cross plane of first tubular frame 101 and second tubular frame 102, such that the cross planes of first tubular frame 101 and second tubular frame 102 are substantially parallel (e.g., a wheel-like frame or a drum-like apparatus). Similarly to first tubular frame 101 and second tubular frame 102, support members 103 may be in a tubular shape and made of strong or hard enough material (e.g., steel tube, fiber glass) that can support the weight of a typical user. In one embodiment, each of support members 103 is made of a steel tube or steel rod.

Figure 2:
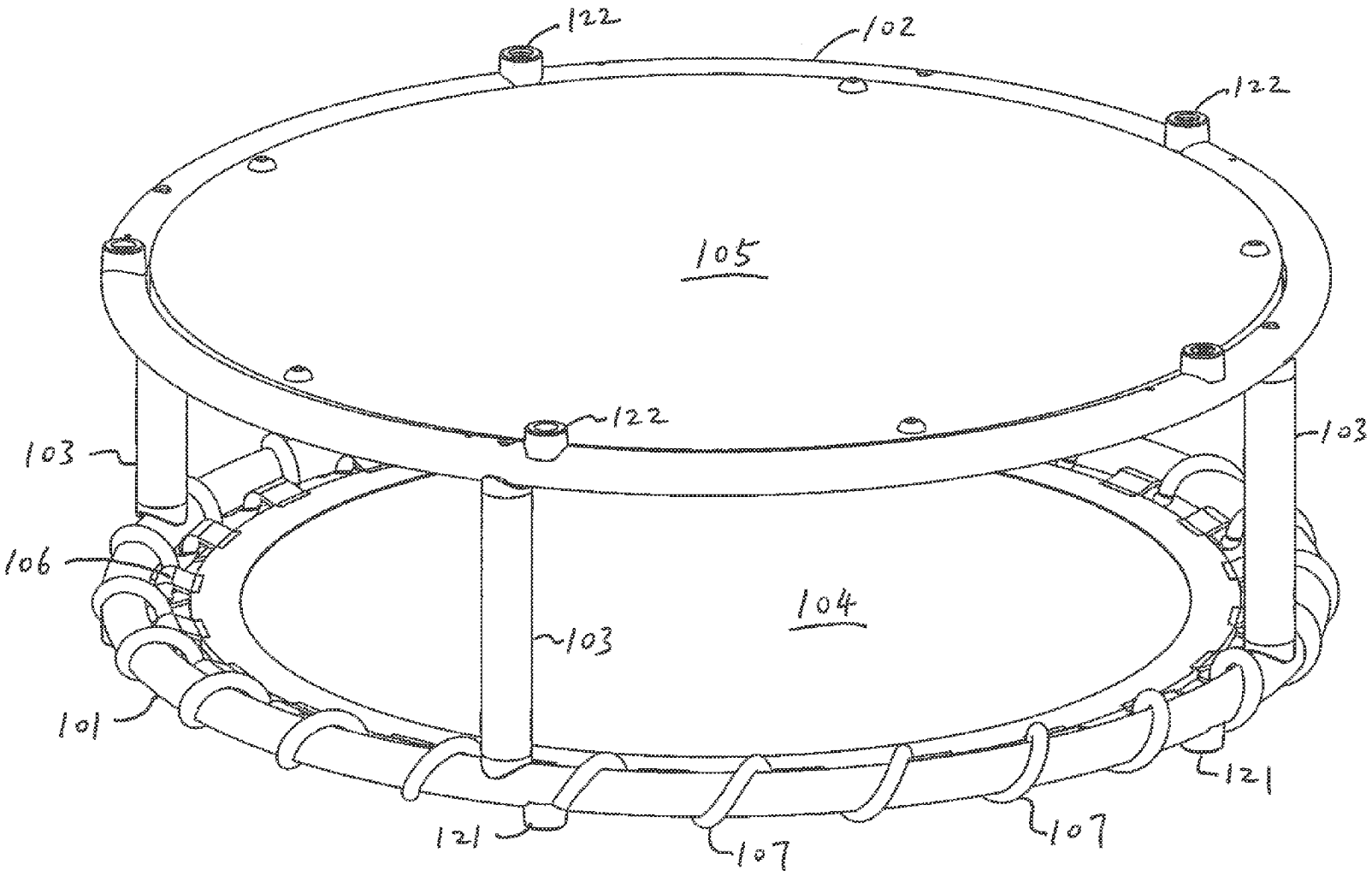

In one embodiment, exercise device 100 can be used as either a trampoline or a stepping device. When second tubular frame 102 is placed on a substantially flat surface or support platform (e.g., a floor or ground) as shown in FIG. 1, exercise device 100 can be utilized as a trampoline or a rebounding apparatus that a user can step and rebound on fabric 104. In this configuration, fabric 104 is utilized as a jumping mat, a rebound mat, or a trampoline mat. When first tubular frame 101 is placed on the substantially flat surface or support platform as shown in FIG. 2, exercise device 100 can be utilized as a step exercise device that a user can step or sit on rigid board 105, where rigid board 105 is utilized as a stepping board or a bench, for example, for aerobic dance, etc. Examples of usages of exercise device 100 are shown in FIGS. 7A-7F.

In one embodiment, exercise device 100 further includes an array of hooks or belt loops disposed substantially evenly on the edge of fabric 104, such as hooks or mesh belt loops 106. Exercise device 101 further includes a string or rope 107 inserted or traveling through an opening of each of hooks 106. The size or diameter of fabric 104 is slightly smaller than a diameter of a cross plane of first tubular frame 101. String or rope 107 is configured to wrap around first tubular frame 101, while stretching and pulling fabric 104 outwardly towards first tubular frame 101 via hooks 106 to form a tension surface. Hooks or mesh belt loops 106 mesh belt loop may be made of a wear resistant and heat tolerance material. Hooks or mesh belt loops 106 may be attached to the edge of fabric 104 using machine sewing. String 107 may include a rubber tube or rubber string enclosed by a wear resistant and heat tolerance material to form a tension rope. The tension rope provides resistance and stores energy when a user steps onto fabric 104. Unlike a conventional trampoline, the configuration as shown in FIG. 1 does not use any metal springs or coils, which is more expensive and easier to break or dislocate. Rather, tension rope 107 is utilized to tie fabric 104 to first tubular frame 101, which is safer, more reliable, and easier to disassemble.

In one embodiment, exercise device 100 further includes an array of mounting brackets 108 substantially evenly distributed and fixedly attached to second tubular frame 102. Mounting brackets 108 may be welded onto an inner edge or inner surface of tubular frame 102. Rigid board 105 then sits onto the top of mounting brackets 108 and is mounted on the mounting brackets 108, for example, using screws and/or nuts. In this embodiment, mounting brackets 108 are positioned between an interior surface of rigid board 105 and tubular frame 101. In one embodiment, an exterior surface (e.g., the surface away from first tubular frame 101) of rigid board 105 is coated with anti-slippery material, such as rubber, rubber-like, leather, leather-like material, or a combination thereof.

Figure 3:
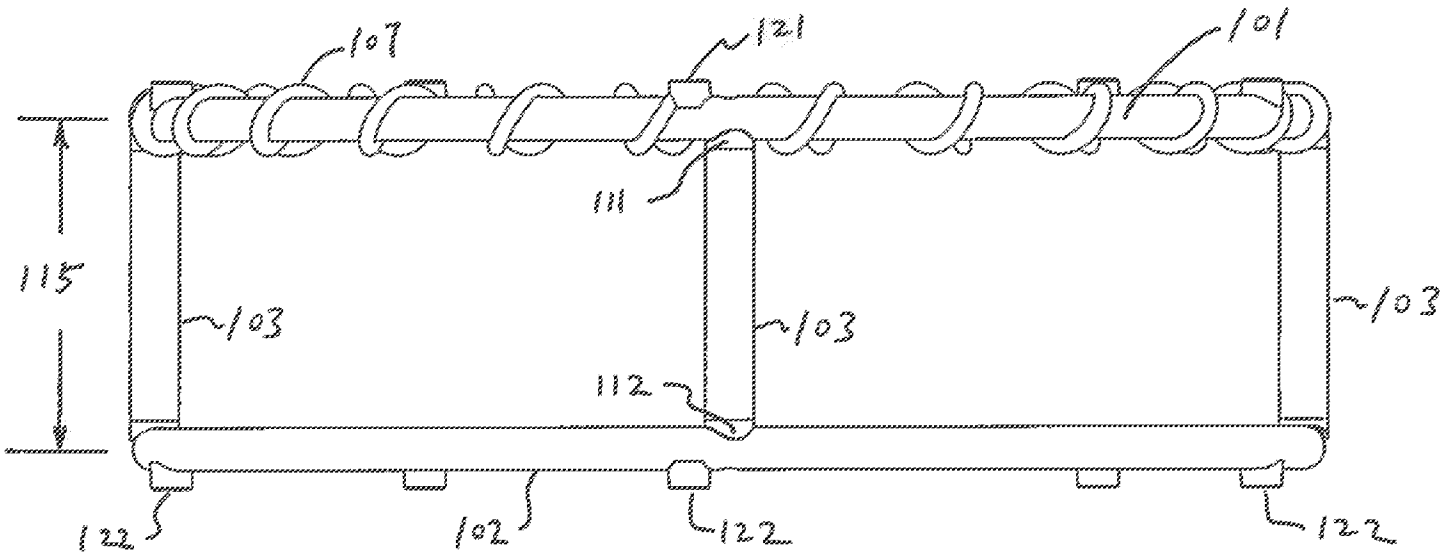
FIG. 3 shows a side view of an exercise device according to one embodiment of the invention.

FIG. 3 shows a side view of exercise device 100 according to one embodiment of the invention. Referring to FIG. 3, in one embodiment, each of elongate support members 103 includes a first end fixedly attached to tubular frame 101 and a second end fixedly attached to tubular frame 102. Each of the first end and the second end may be screw threaded to allow a screw to be inserted from the top of tubular frame 101, through a mounting hole disposed across the cross section of tubular ring, and screwed onto the screw thread to mount the corresponding support member.

In one embodiment, exercise device 100 further includes a first set of plastic sleeves 111 disposed between the first ends of elongate support members 103 and tubular frame 101. Exercise device 100 further includes a second set of plastic sleeves disposed between the second ends of elongate support members 103. Plastic sleeve 111 includes a mounting hole (not shown) to allow a screw inserted therethrough. Plastic sleeve 111 includes a flat surface facing the first end of elongate support member 103 and a sunken surface or sunken well facing tubular frame 101. The sunken surface or sunken well is conformed to an exterior surface of tubular frame 101 to allow elongate support member 103 to be tightened to tubular frame 101. Similarly, plastic sleeve 112 includes a mounting hole (not shown) to allow a screw inserted therethrough. Plastic sleeve 112 includes a flat surface facing the second end of elongate support member 103 and a sunken surface or sunken well facing tubular frame 102. The sunken surface or sunken well is conformed to an exterior surface of tubular frame 102 to allow elongate support member 103 to be tightened to tubular frame 102. In one embodiment, distance 115 between the cross plane of first tubular frame 101 and the cross plane of second tubular frame 102 is approximately 8 inches. Diameter 116 of each elongate support member 103 is approximately 1 inch.

According to one embodiment, exercise device 100 further includes a set of stands 121 amounted on an exterior side of tubular frame 101 (e.g., away from tubular frame 102). Stands 121 may be made of plastic, rubber, rubber-like, or any anti-slippery material that can provide friction against a support surface (e.g., a floor or ground) when tubular frame 101 is placed on the support surface. Stands 121 will raise or separate tubular frame 101 from the support surface to prevent tubular frame 101 from scratching the support surface, or vice versa. In one embodiment, each of stands 121 includes a near end attached to tubular frame 101 and a far end having a sunken well. The near end of each of stands 121 includes a surface matching an exterior shape of tubular frame 101. Each of stands 121 further includes a mounting hole to allow a screw to be inserted through the sunken well. Each of stands 121 is mounted on tubular frame 101 by screwing a screw onto a screw-threaded hold of tubular frame 101, without exposing the screw outside of the sunken well to prevent the screw from scratching the support surface.

Similarly, according to one embodiment, exercise device 100 further includes a set of stands 122 amounted on an exterior side of tubular frame 102 (e.g., away from tubular frame 101). Stands 122 may be made of plastic, rubber, rubber-like, or any anti-slippery material that can provide friction against a support surface (e.g., a floor or ground) when tubular frame 102 is placed on the support surface. Stands 122 will raise or separate tubular frame 102 from the support surface to prevent tubular frame 102 from scratching the support surface, or vice versa. In one embodiment, each of stands 122 includes a near end attached to tubular frame 102 and a far end having a sunken well. The near end of each of stands 122 includes a surface matching an exterior shape of tubular frame 102. Each of stands 122 further includes a mounting hole to allow a screw to be inserted through the sunken well. Each of stands 122 is mounted on tubular frame 102 by screwing a screw onto a screw-threaded hold of tubular frame 102, without exposing the screw outside of the sunken well to prevent the screw from scratching the support surface.

Figure 4:
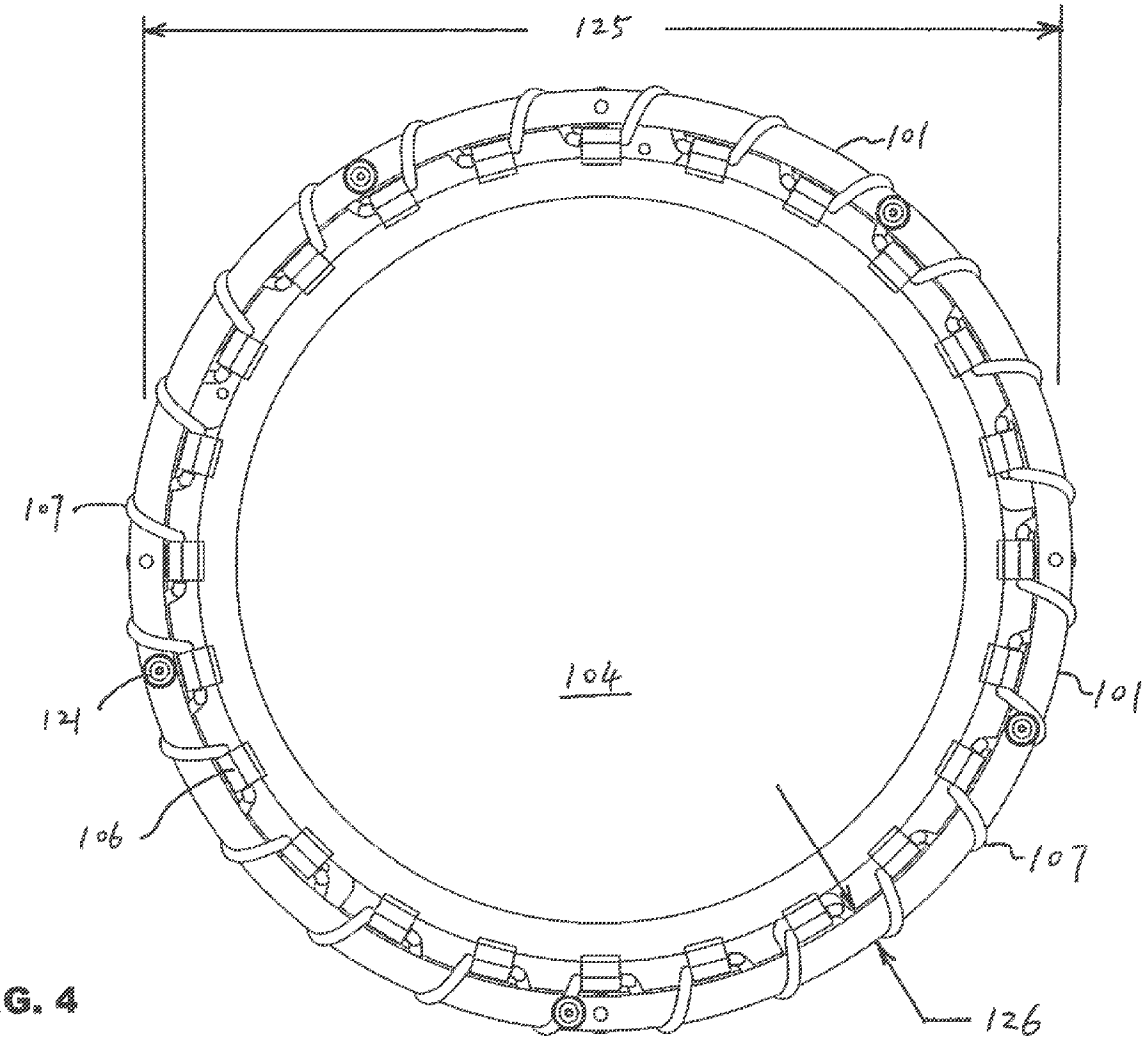
FIG. 4 shows a top view of an exercise device according to one embodiment of the invention.
Figure 5:
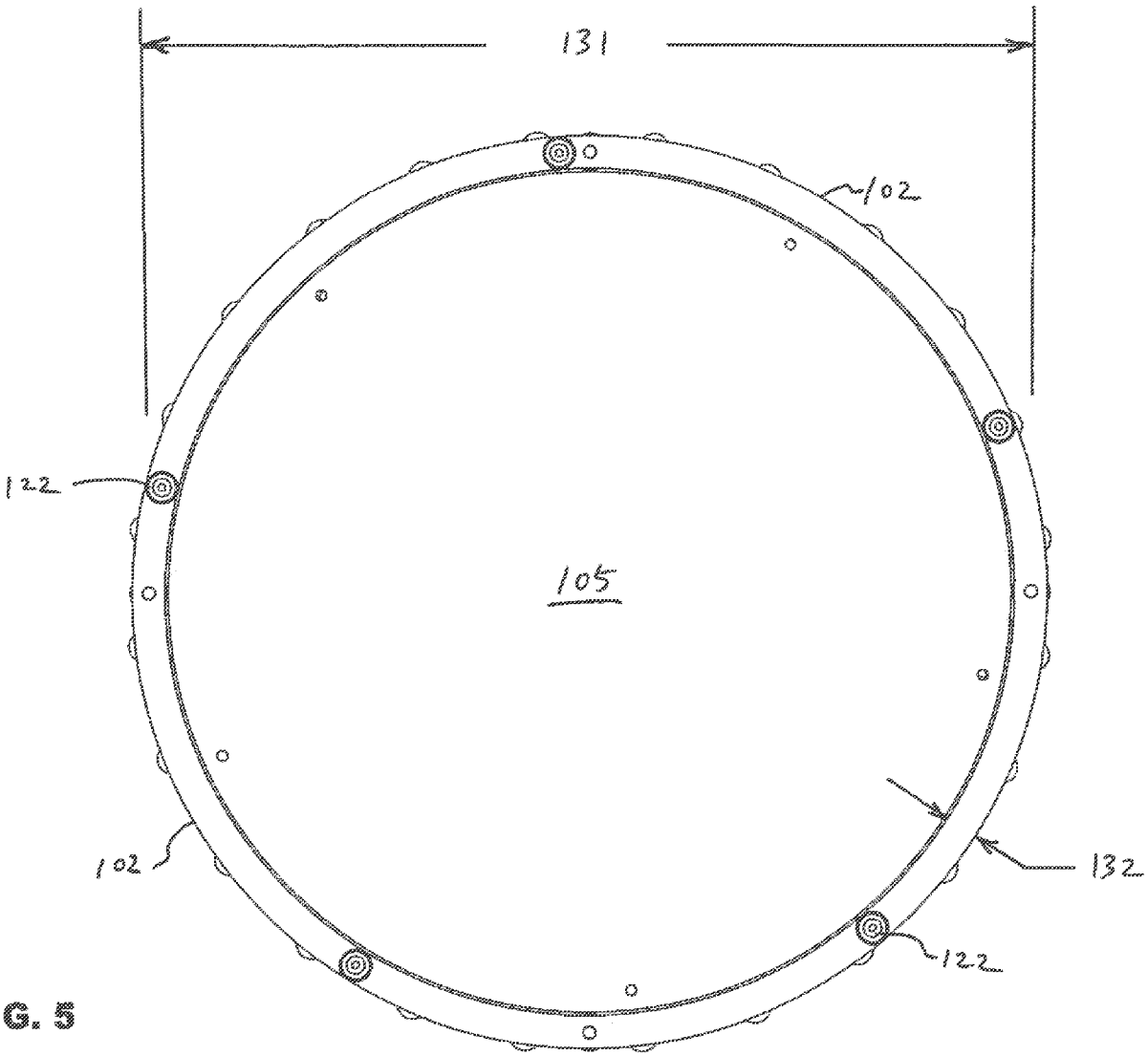
FIG. 5 shows a bottom view of an exercise device according to one embodiment of the invention.
Figure 6:
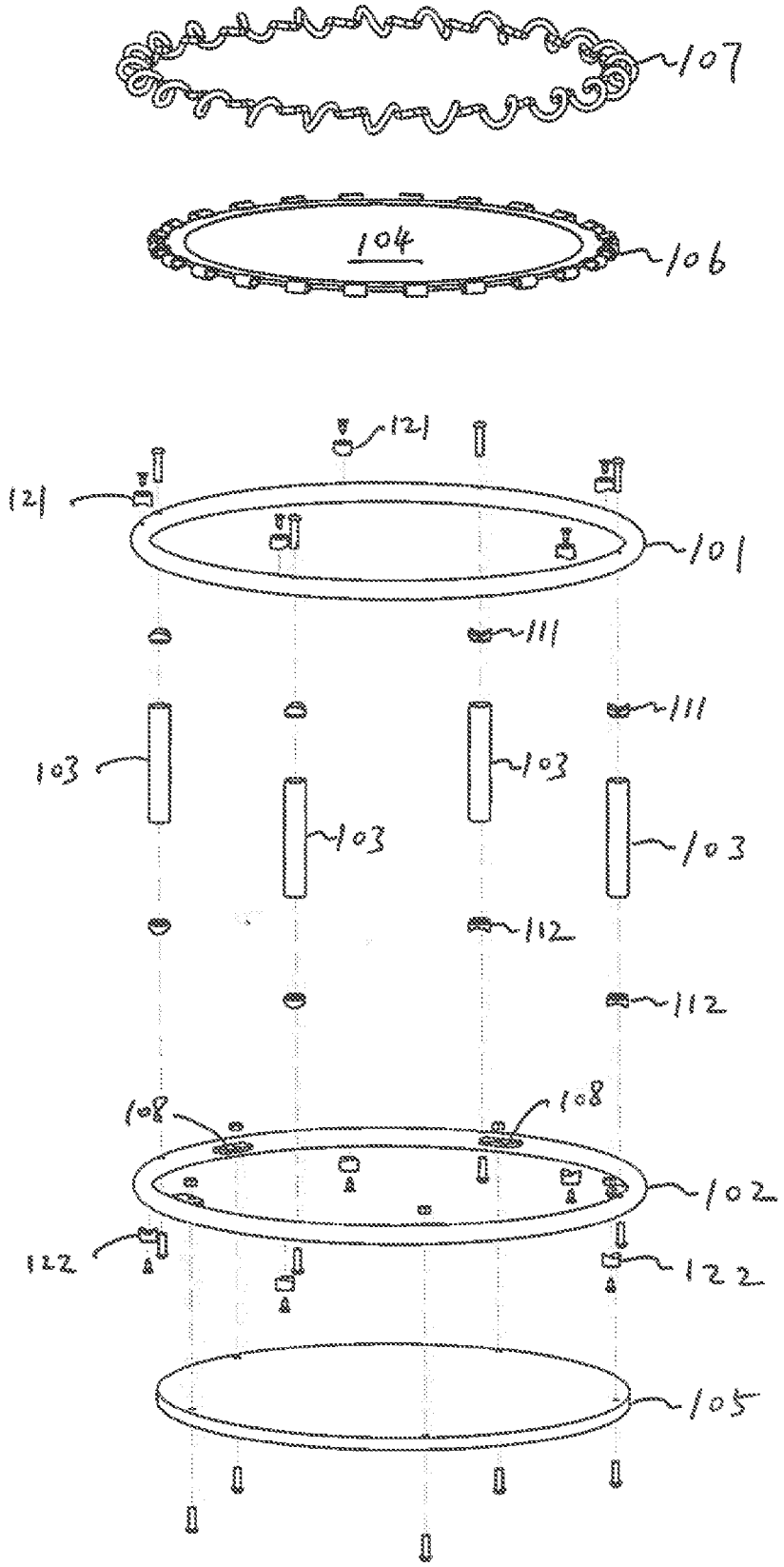
FIG. 6 shows an explosive view of an exercise device according to one embodiment of the invention.
Figure 7A:
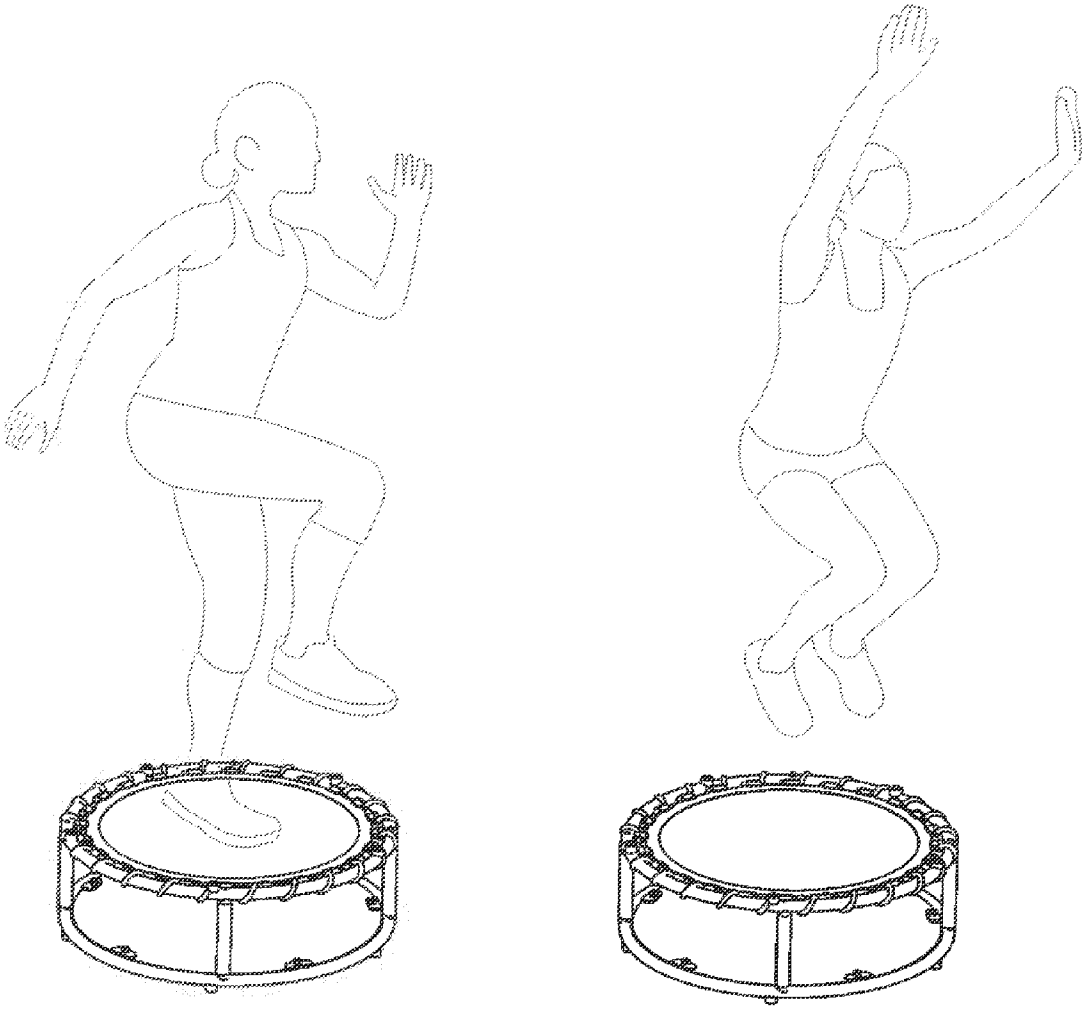
FIGS. 7A-7F show usages of an exercise device according to some embodiments of the invention.
Figure 7B:
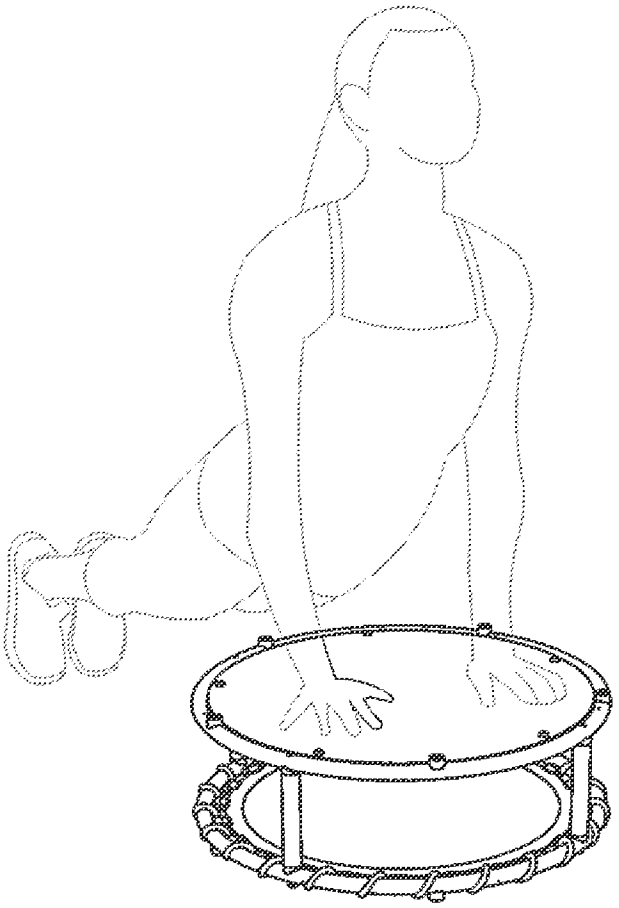
Figure 7B:
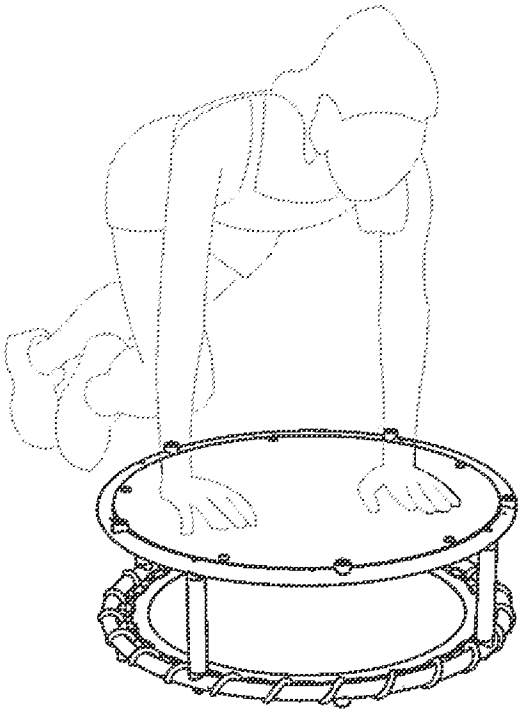
Figure 7C:
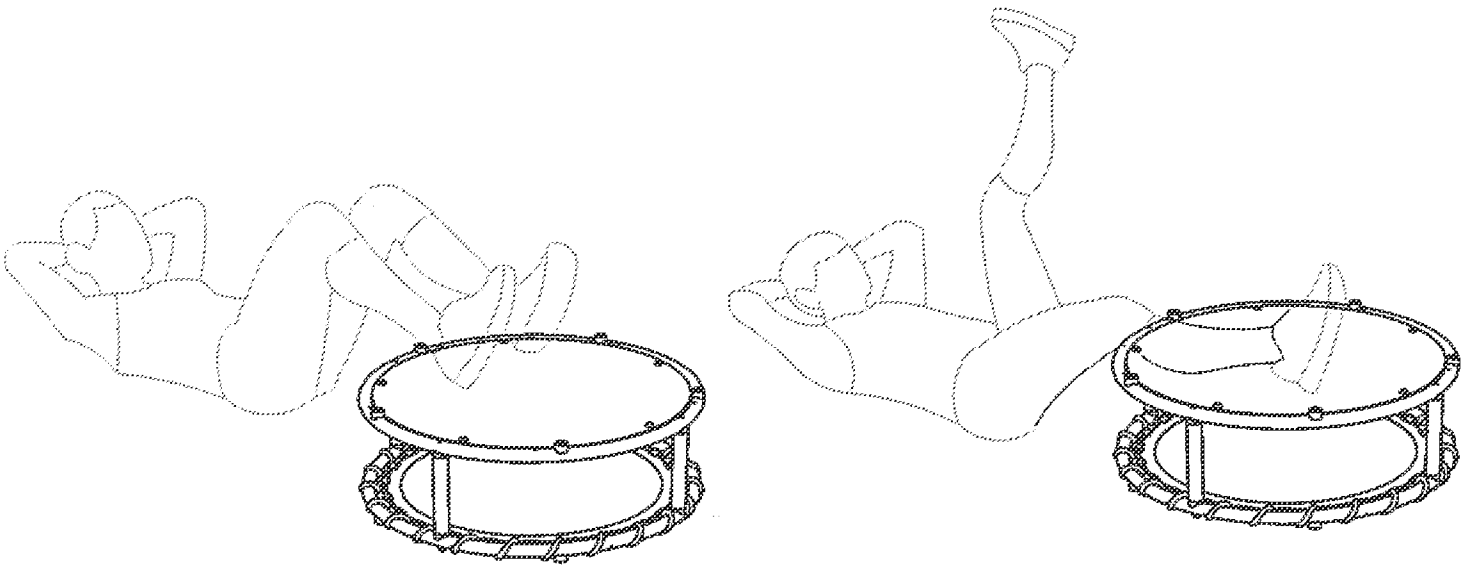
Figure 7D:
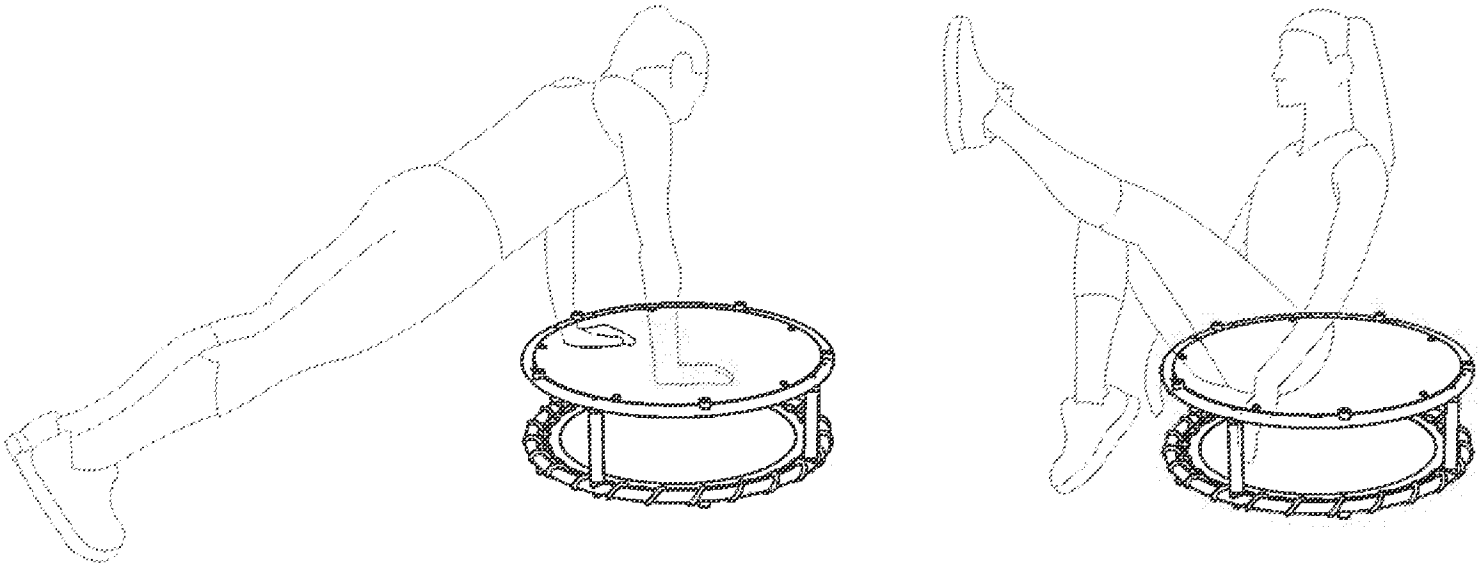
Figure 7E:
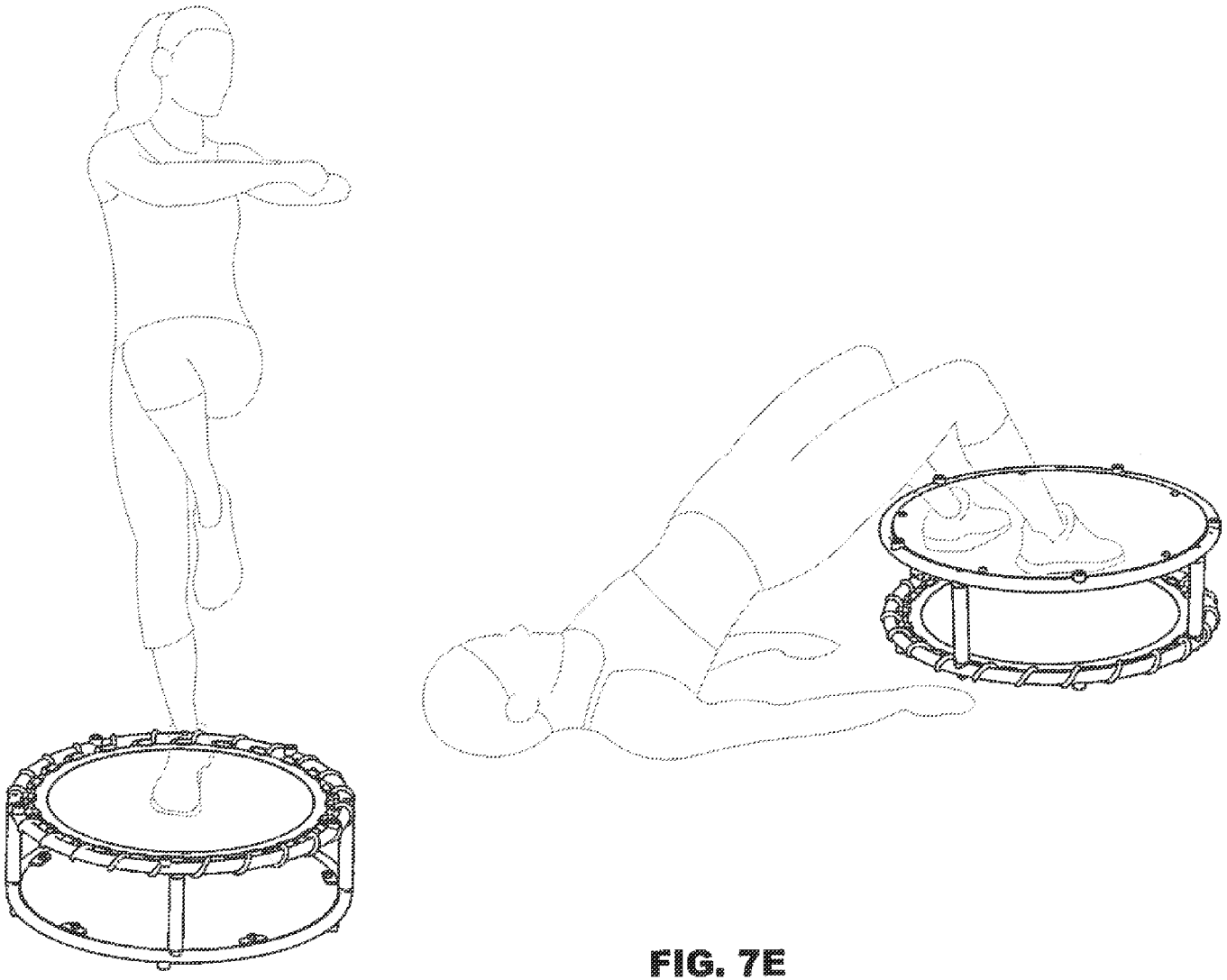
Figure 7F:
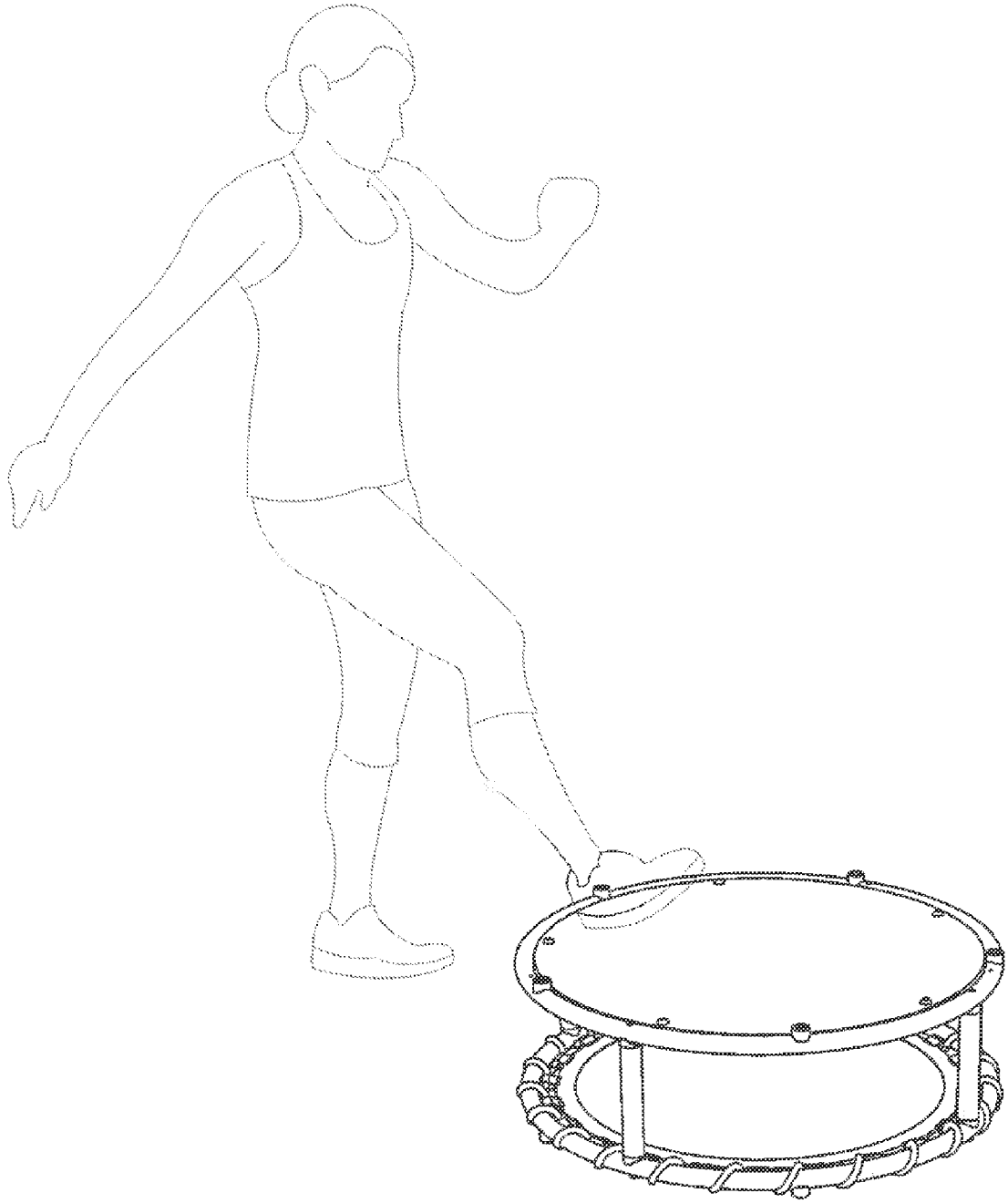

FIG. 4 is a top view of an exercise device according to one embodiment of the invention. Referring to FIG. 4, diameter 125 of the cross plane of tubular frame 101 is approximately 24 inches. Diameter 126 of a tubular elongate tube or rod that forms tubular frame 101 is approximately 0.86 inches. Similarly, as shown in FIG. 5, which is a bottom view of the exercise device, diameter 131 of the cross plane of tubular frame 102 is approximately 24 inches. Diameter 132 of a tubular elongate tube or rod that forms tubular frame 102 is approximately 0.86 inches. FIG. 6 is an explosive view of an exercise device according to one embodiment of the invention.

In the foregoing specification, embodiments of the invention have been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

What is claimed is:

1. An exercise device, comprising:

a first tubular frame having a flexible fabric attached thereon;

a second tubular frame having a rigid board mounted thereon; and at least three elongate support members disposed between and separate the first tubular frame and the second tubular frame, wherein each of the elongate members includes a first end fixedly mounted on the first tubular frame and a second end fixedly mounted on the second tubular frame, such that a first cross plane of the first tubular frame is substantially parallel to a second cross plane of the second tubular frame, wherein when the second tubular frame is placed on a substantially flat surface, the exercise device can be used as a jumping exercise device and the flexible fabric mounted on the first tubular frame can be used as a bouncing mat, and wherein when the first tubular frame is placed on the substantially flat surface, the exercise device can be used as a stepping exercise device and the rigid board mounted on the second tubular frame can be used as a stepping board or a bench.

2. The exercise device of claim 1, wherein each of the first tubular frame and the second tubular frame comprises a circular steel frame, and wherein the fabric and the rigid board are in a circular shape fitting within a circular area within the circular steel frame.

3. The exercise device of claim 2, wherein a diameter of the circular steel frame is approximately 24 inches.

4. The exercise device of claim 1, wherein the fabric comprises a plurality of hooks, wherein the fabric is stretched outwardly and tightened to the first tubular frame using a string inserted through the hooks and wrapped around the first tubular frame.

5. The exercise device of claim 4, wherein the first tubular frame is formed by a steel tube or steel rod, and wherein the string is wrapped around the steel tube or the steel rod by pulling the fabric outwardly via the hooks to form a tension surface.

6. The exercise device of claim 5, wherein a diameter of the steel tube or the steel rod is approximately 0.86 inches.

7. The exercise device of claim 4, wherein each of the hooks of the fabric comprises a mesh belt loop sewed on an edge of the fabric, and wherein each mesh belt loop is made of a wear resistant and heat tolerance material.

8. The exercise device of claim 4, wherein the string comprises a rubber tube or rubber string enclosed by a wear resistant and hear tolerance material to form a tension rope.

9. The exercise device of claim 1, wherein the second tubular frame is formed by a steel tube or steel rod, wherein the second tubular frame comprises a plurality of mounting brackets disposed on an interior edge of the steel tube or the steel rod, and wherein the rigid board is mounted on the mounting brackets.

10. The exercise device of claim 9, wherein a diameter of the steel tube or steel rod is approximately 0.86 inches.

11. The exercise device of claim 1, wherein the rigid board is made of wooden material, and wherein an exterior side of the rigid board is covered by a coating of anti-slippery material.

12. The exercise device of claim 1, wherein each of the elongate support members comprises a metal tube, and wherein the first end and the second end of each of the elongate support members comprises a screw thread to allow the elongate support member to fixedly mounted on the first tubular frame and the second tubular frame using a pair of screws.

13. The exercise device of claim 12, further comprising a first plastic sleeve disposed between the first end of each elongate support member and the first tubular frame, wherein the first plastic sleeve comprises a first flat surface facing the first end of the elongate support member and a first sunken well facing the first tubular frame, the first sunken well having a shape conforming to an exterior surface of the first tubular frame.

14. The exercise device of claim 13, further comprising a second plastic sleeve disposed between the second end of each elongate support member and the second tubular frame, wherein the second plastic sleeve comprises a second flat surface facing the second end of the elongate support member and a second sunken well facing the second tubular frame, the second sunken well having a shape conforming to an exterior surface of the first tubular frame.

15. The exercise device of claim 12, wherein a diameter of the metal tube is approximately 1 inch.

16. The exercise device of claim 12, wherein a distance between the first cross plane of the first tubular frame and the second cross plane of the second tubular frame is approximately 8 inches.

17. The exercise device of claim 1, further comprising a first set of rubber stands mounted on the first tubular frame, wherein the first set of rubber stands provide anti-slippery friction against the substantially flat surface when the first tubular frame is placed on the substantially flat surface.

18. The exercise device of claim 17, further comprising a second set of rubber stands mounted on the second tubular frame, wherein the second set of rubber stands provide anti-slippery friction against the substantially flat surface when the second tubular frame is placed on the substantially flat surface.

* * * * *